US006068457A

United States Patent [19]

Dewhirst

[11] Patent Number: 6,068,457

[45] Date of Patent: May 30, 2000

[54] LOBED PINION DRIVE SHAFT FOR REFRIGERATION COMPRESSOR

[75] Inventor: Randy E. Dewhirst, Onalaska, Wis.

[73] Assignee: American Standard Inc., Piscataway, N.J.

[21] Appl. No.: 09/204,867

[22] Filed: Dec. 3, 1998

[51] Int. Cl.[7] ..... F04B 17/00

[52] U.S. Cl. ..... 417/423.6; 417/243; 415/230

[58] Field of Search ..... 417/243, 440, 417/423.6; 415/230, 60; 74/63; 29/888.025; 418/14; 384/99

[56] References Cited

U.S. PATENT DOCUMENTS

| | | | |
|---|---|---|---|
| 3,658,442 | 4/1972 | Heltmann | 417/243 |
| 3,711,225 | 1/1973 | Kolbe et al. | 417/440 |
| 3,913,408 | 10/1975 | Moore | 74/63 |
| 4,961,260 | 10/1990 | Ferri et al. | 29/888.025 |
| 5,046,932 | 9/1991 | Hoffmann | 418/14 |
| 5,087,172 | 2/1992 | Ferri et al. | 415/230 |
| 5,169,242 | 12/1992 | Biase et al. | 384/99 |

FOREIGN PATENT DOCUMENTS

DIN 32 711 of 0000 Germany .

OTHER PUBLICATIONS

"Packaged Air Cooled CenTraVac", 130–340 Tons/Centrifugal Liquid Chillers/ Refrigeration, DS CTV–9/Jun. 80. P. 6. Author: The Trane Company.

*Primary Examiner*—Teresa Walberg
*Assistant Examiner*—Leonid Fastovsky
*Attorney, Agent, or Firm*—William J. Beres; William O'Driscoll; Peter D. Ferguson

[57] ABSTRACT

A refrigeration unit having a compressor includes a refrigerant gas inlet, a drive shaft, and at least one compression stage. At least one compression stage includes at least one impeller with a hub, the hub having a radially lobed bore. The drive shaft has a radially lobed portion complementary to the radially lobed bore of the impeller hub. The lobed portion of the drive shaft is received in the bore to define a coupling for transmitting torque from the drive shaft to the impeller. This coupling may have three lobes. The compressor may have more than one stage and more than one impeller. The first stage impeller is closer to the refrigerant gas inlet than the second stage impeller. The second stage impeller has a hub and radially lobed bore, wherein a second radially lobed portion of the drive shaft can be inserted to define another coupling. The cross-sectional area of this second coupling may be greater than the cross-sectional area of the first coupling. The compressor may be gear driven or direct driven.

24 Claims, 3 Drawing Sheets

LOBED PINION DRIVE SHAFT FOR REFRIGERATION COMPRESSOR

BACKGROUND OF THE INVENTION

The present invention relates to the pinion drive shaft of a refrigeration compressor. In particular, the present invention is directed to the coupling between the pinion drive shaft and one or more impellers in either a direct drive or gear drive centrifugal compressor.

Prior to this invention, the pinion drive shafts of refrigeration compressors have had generally circular ends, and have been splined or keyed in one or more places to facilitate their connection to one or more impellers of the compressor.

Different sized pinion drive shaft couplings are beneficial to optimal performance of a refrigeration compressor. But the spline shaft portions used in the prior art are not easily machined to different sizes on the same shaft.

In addition, splined or keyed shafts are susceptible to high stress concentrations due to the stress risers inherent in the multi-faceted and intricately machined splines and keys. For example, consider a small-diameter portion of a shaft which steps to a larger diameter and has a spline on the small-diameter portion. To accommodate hob runout at the end of each flute of the spline, either the small-diameter portion must extend beyond the spline, causing the shaft to be weaker, or the hob runout must extend into the larger-diameter shaft portion. This latter accommodation is more difficult and also weakens the larger-diameter shaft portion.

It is beneficial for optimal refrigerant gas flow and overall performance of the compressor to have the pinion shaft-impeller coupling nearest the refrigerant gas inlet have as small a cross-sectional area as possible. By the same token, in order to raise the natural frequency of the system, thus making the compressor more stable and balanced, it is important that the pinion shaft-impeller couplings for the rest of the impellers in the compressor have increasingly larger cross-sectional areas. Similarly, as the compressor increases in size, the pinion shaft size is increased, thereby also increasing the size of the cross-sectional area of the shaft-impeller coupling.

A German standard, DIN 32711, for machining "driving components," particularly drive shafts, discloses a non-circular, radially lobed drive shaft portion that fits into a bore of complementary shape in a driven component to couple the shaft and driven component. However, refrigeration compressors are not believed to have employed such a lobed drive shaft, particularly in two-stage or multi-stage compressors having two or more such couplings on a stepped shaft.

BRIEF SUMMARY OF THE INVENTION

An object of the invention is to provide a more stable and balanced rotating shaft-impeller coupling, thus improving the efficiency and operation of a refrigeration compressor.

It is an object, feature and advantage of the present invention to provide a shaft which carries more torque in a smaller package.

It is an object, feature and advantage of the present invention to reduce the axial length of a stepped shaft where that stepped shaft supports at least two impellers.

It is an object, feature and advantage of the present invention to provide an impeller shaft which is not as susceptible to stress or fretting as splined or keyed shaft.

It is an object, feature and advantage of the present invention to center the impeller on the shaft whenever torque is applied.

Another object of the invention is to provide a shaft-impeller coupling having a more uniform fit than is possible with spline or key shaft-impeller couplings in which space exists between the shaft and the hub of the impeller.

To achieve at least one of the objects at least in part, and in accordance with the purpose of the invention, as embodied and broadly described herein, the chiller of the present invention includes a compressor including a refrigerant gas inlet, a drive shaft, and at least one compression stage. In one embodiment, the compressor has at least two compression stages. An impeller in the compressor includes a hub and a radially lobed bore in the hub. The drive shaft has a first radially lobed portion complementary to the radially lobed bore and is received in the bore to define a first coupling for transmitting torque from the drive shaft to the impeller. In one embodiment, the radially lobed portion of the drive shaft has three lobes.

An advantage of this invention is to allow the pinion shaft to be readily machined to form two or more lobed portions of different sizes on the same shaft, as when the shaft carries two or more impellers of a two or more stage compressor.

A further advantage of having a lobed shaft-impeller coupling is to virtually eliminate "fretting" or corrosion and chipping of the connective teeth defined between the flutes of a spline. A lobed shaft-impeller coupling also eliminates hob runout of splines, and may eliminate virtually all of the stress risers associated with the multi-faceted splines and keys.

It is advantageous to have a three-lobed shaft-impeller coupling as opposed to a two, four or more lobed coupling for optimal mechanical performance. The three-lobed pinion shaft-impeller coupling greatly reduces the impellers' tendency to slide down the shaft during operation, as is common with four lobed or splined or keyed pinion shafts.

The pinion drive shaft's ability to carry more torque because of the radially lobed portion results in a higher energy yield from the compressor without having to increase the size of the drive shaft as much as would be necessary with a spline or key shaft coupling. The increased concentricity that results from the radially lobed coupling increases the stability and balance of the shaft-impeller assembly, thus improving the overall mechanical performance of the compressor.

Additional objects and advantages of the invention will be set forth in part in the description that follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention as claimed.

The accompanying drawings, which are incorporated in and constitute a part of this specification, illustrate embodiments of the invention and together with the description, serve to explain the principles of the invention.

DETAILED DESCRIPTION OF THE INVENTION

Reference will now be made in detail to the present preferred embodiment of the invention, an example of which is illustrated in the accompanying drawings. The same reference numbers will be used throughout the drawings to refer to the same or like parts.

While the invention will be described in connection with one or more embodiments, it will be understood that the invention is not limited to these embodiments. On the contrary, the invention includes all alternatives, modifications, and equivalents as may be included within the spirit and scope of the appended claims.

Figure 1:
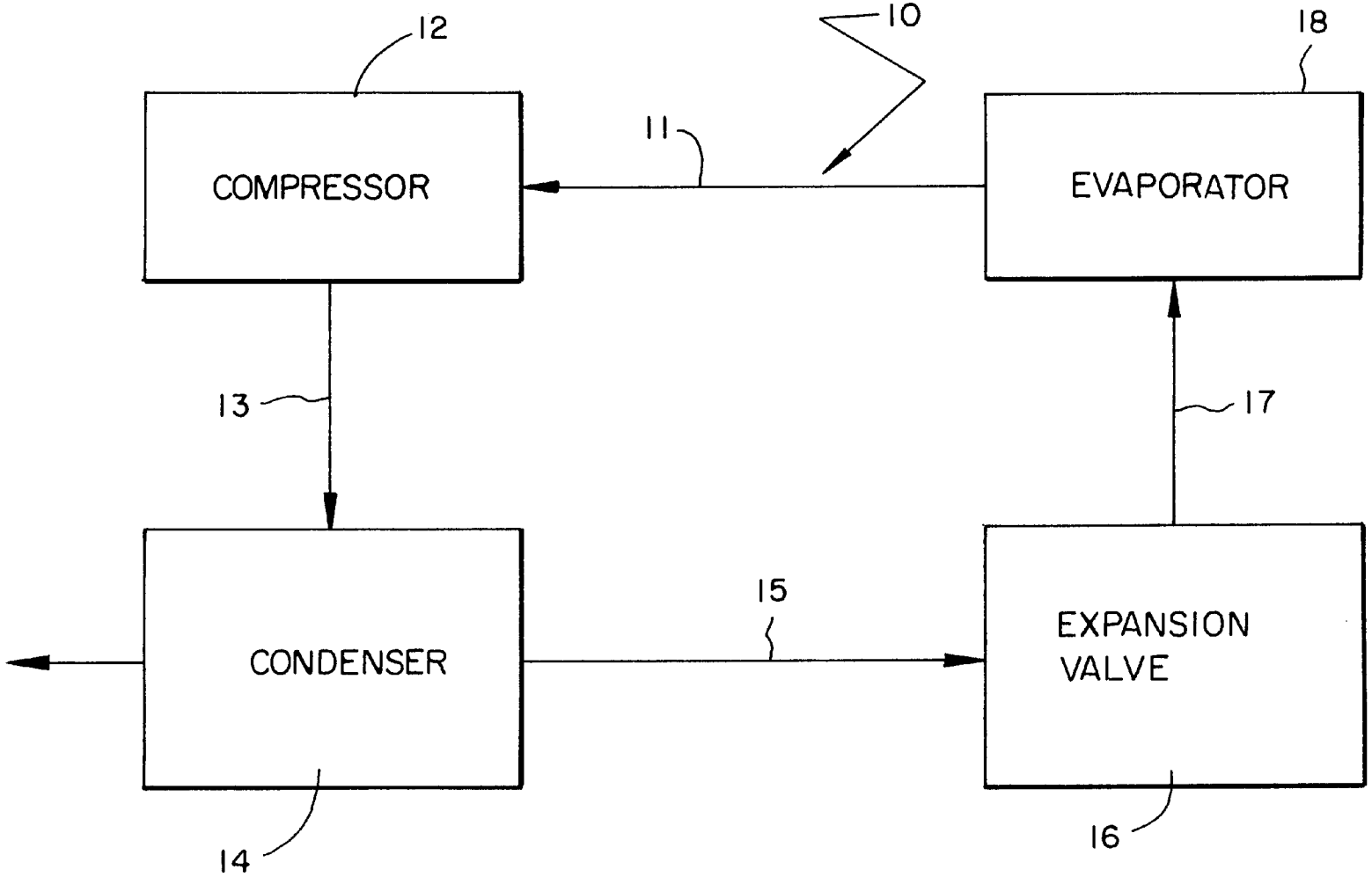
FIG. 1 is a block diagram of a chiller showing the major components and the flow of the refrigerant through the chiller.

FIG. 1 schematically shows a mechanical chiller system 10 including a compressor 12, a condenser 14, an expansion valve 16, and an evaporator 18. These components are connected to form a refrigerant circuit by refrigerant conduits 11, 13, 15 and 17. Refrigerant gas enters the compressor 12 from the conduit 11 and is compressed in the compressor 12, thus raising its temperature. The compressed gas from the compressor 12 enters the condenser 14 via the conduit 13. In the condenser 14, the hot, compressed gas is condensed into liquid form and contacted with a heat sink, such as ambient air, ground water, or another cooler medium, to remove heat from the condensing refrigerant. The condensed refrigerant passes through the conduit 15 and through an expansion valve 16. The expansion valve 16 allows a limited quantity of liquid refrigerant to enter the evaporator 18, while maintaining the pressure difference between the condenser 14 (at higher pressure) and the evaporator 18 (at lower pressure). The liquid refrigerant entering the evaporator 18 evaporates after contacting a heat load, preferably a fluid such as water that is to be cooled, thus absorbing heat from the heat load. The refrigerant vapor leaves the evaporator 18 via the conduit 11, returning to the compressor 12 to repeat the cycle.

Figure 2:
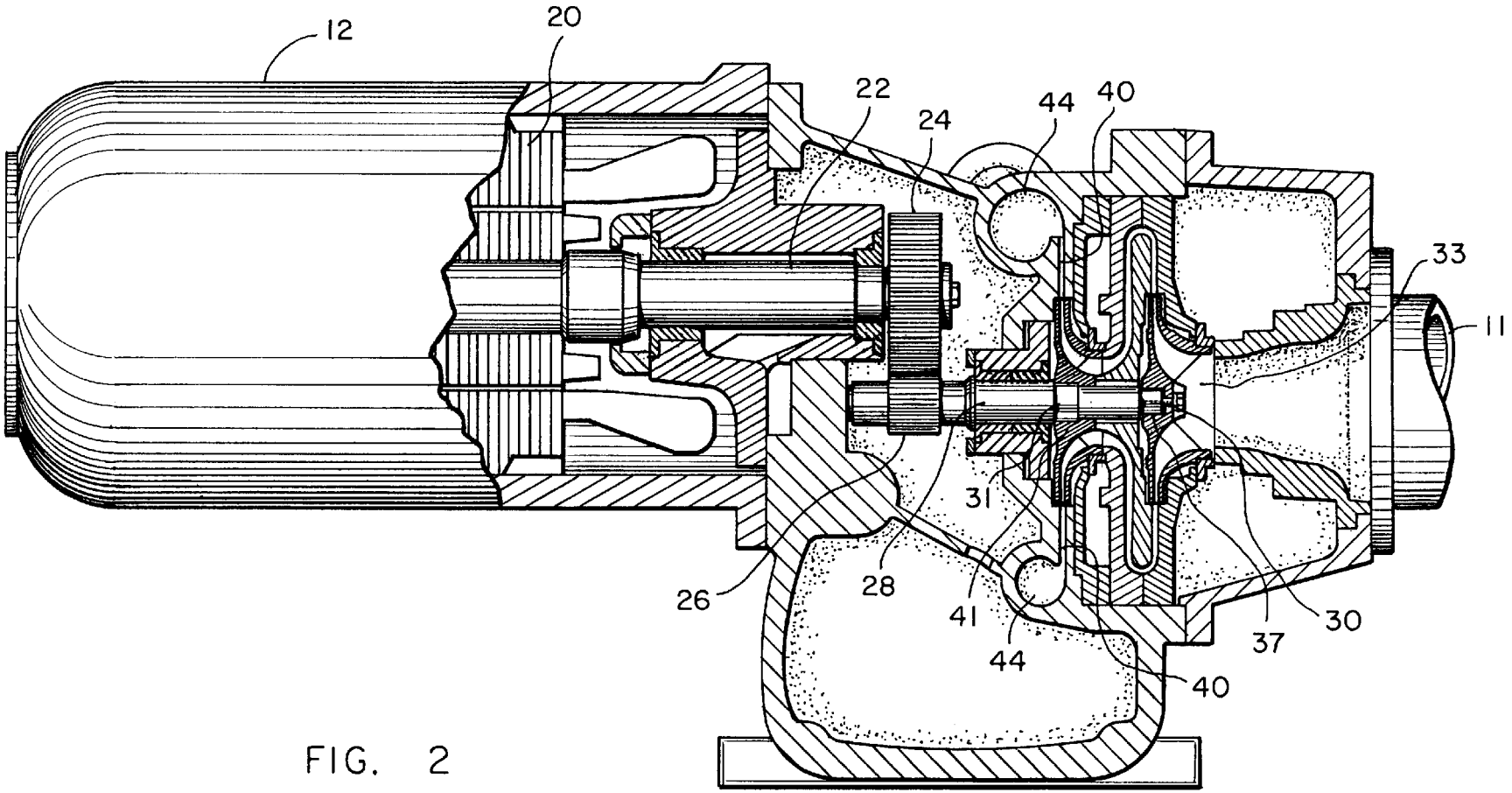
FIG. 2 is a side elevation, cut away to show the interior features, of a representative embodiment of the refrigeration compressor of the present invention.

Now referring in particular to FIG. 2, and specifically to the interior of the gear-driven compressor 12 pictured therein, the gear-driven refrigeration compressor 12 includes impellers 37 and 41 (more clearly seen in FIG. 3) carried on a pinion drive shaft 28 and a motor 20 to drive the shaft. The compressor 12 has an inlet conduit 11, an outlet conduit 13 and internal passages 40 directing refrigerant gas into and through the impellers 37 and 41.

The motor 20 drives a low-speed output shaft 22, typically at about 3600 RPM. A bull gear 24 is attached to the low speed shaft 22, and drives the pinion gear 26 integrally with the pinion drive shaft 28 in the range of 9,000 to 12,000 RPM depending on the compressor sizing. Although preferably applied to gear drive compressors as described herein, the invention also applies to direct drive compressors. A direct drive compressor, such as those sold by The Trane Company of La Crosse, Wis., under the trademark CenTraVac, would have the motor 20 directly attached to the pinion drive shaft 28 driving the impellers 37 and 41.

A conduit 11 feeds refrigerant to the gas inlet 33. The internal passages 40 include a circular diffuser passage 40*a* and a gas collecting space known as a volute 44 at the perimeter of the compressor 12. In operation, hot refrigerant vapor enters the gas inlet 33 from the piping conduit 11 and flows to the first impeller 37. Once the gas is inside the rotating first impeller 37, this rotation accelerates the gas radially outward as shown by arrow A of FIG. 3. In the multi-stage embodiment of the invention, the compressed gas is directed directly from the first impeller 37 into the second impeller 41 as shown by arrow B, and again radially accelerated as shown by arrow C.

The gas exits the second impeller 41 into a circular diffuser passage 40*a* and then into a gas collecting space known as a volute 44 at the perimeter of the compressor 12. As the gas flows to the volute 44, the volume of the passages available for gas flow increases thereby reducing the velocity of the gas flow. The pressure of the gas is increased as it travels through and around the impellers 37, 41. Eventually, the gas has reached the desired compression ratio and is directed out of the compressor 12 to the condenser 14.

Figure 3:
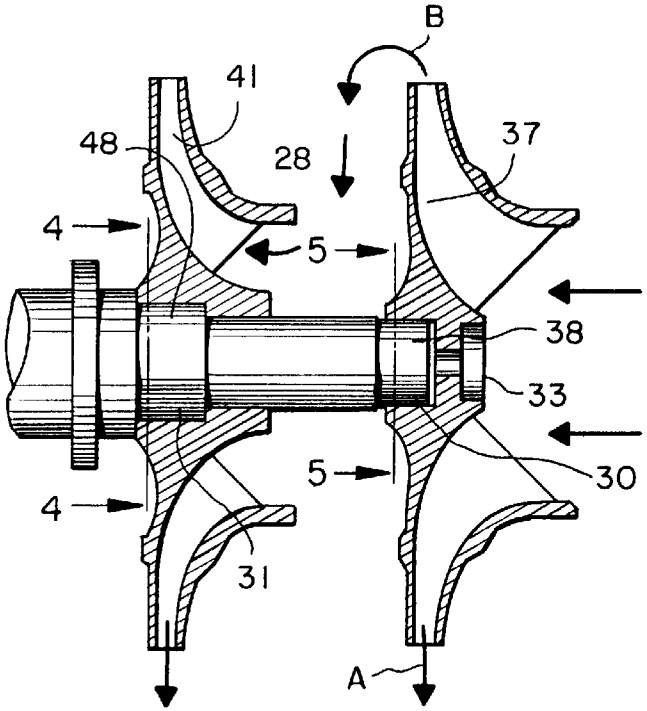
FIG. 3 is a magnified isolated portion of FIG. 1 depicting the pinion drive shaft and two impellers.

Now referring in particular to FIGS. 3–6, the pinion drive shaft 28 includes two radially lobed portions 30 and 31 conventionally machined in the shaft 28. As can best be seen in FIGS. 4 and 5, the impellers 37 and 41, respectively, have radially lobed bores 35 and 39 in their respective hubs 36 and 42. The bore 35 of the first impeller 37 and the bore 39 of the second impeller 41, when complementarily fitted with the first radially lobed portion 30 of the pinion drive shaft 28 and the second radially lobed portion 31 of the shaft 28, form a first coupling 38 and a second coupling 48, respectively, as illustrated in FIG. 3.

FIG. 3 shows the pinion drive shaft 28 in relation to the rest of the compressor 12. The first radially lobed portion 30 of the pinion drive shaft 28 is shown to have a smaller cross-sectional area than the second radially lobed portion 31 of the pinion drive shaft 28.

Figure 4:
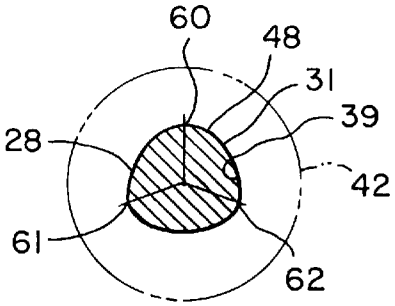
FIG. 4 is a cross-section, taken along line 4—4 in FIG. 3, of the lobed coupling.

FIG. 4 shows the second radially lobed portion 31 of the pinion drive shaft 28 coupled with the radially lobed bore 39 of the second impeller 41. The radially lobed portion 31 is shown to have three lobes 60, 61, and 62, each lobe having a radius r2. The radially lobed bore 39 in the hub 42 of the second impeller 41 is shown to be similarly lobed so as to define the second coupling 48 for transmitting torque from the pinion drive shaft 28 to the second impeller 41.

Figure 5:
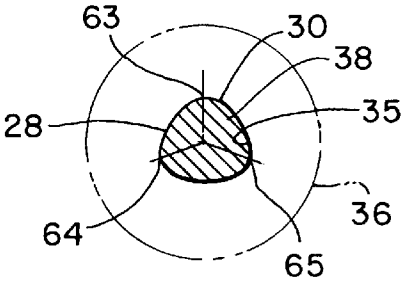
FIG. 5 is a cross-section, taken along line 5—5 in FIG. 3, of the lobed coupling.

FIG. 5 shows the first radially lobed portion 30 of the pinion drive shaft 28 coupled with the radially lobed bore 35 of the first impeller 37 nearest the gas inlet 33. The radially lobed portion 30 of the pinion drive shaft 28 is shown to have three lobes 63, 64, and 65 having a radius r1. The radially lobed bore 35 in the hub 36 of the first impeller 37 is shown to be similarly lobed so as to define the first coupling 38 for transmitting torque from the pinion drive shaft 28 to the first impeller 37.

The radius r2 is larger than r1 so as to increase the stability and natural frequency of the compressor, and also to allow more efficient refrigerant flow from the gas inlet 33 to the first impeller 37. The use of three lobes fits the impellers 37 and 41 more securely onto the pinion drive shaft 28.

Figure 6:
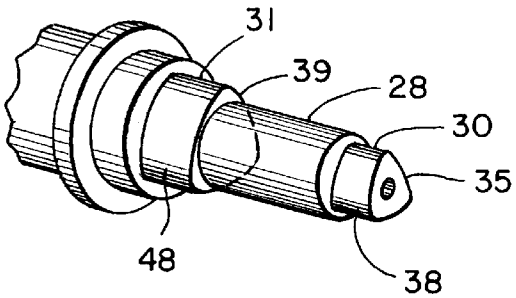
FIG. 6 is an isolated perspective view of the pinion drive shaft, illustrating the different lobe diameters.

FIGS. 4 and 6 show the pinion drive shaft 28 of the preferred embodiment of this invention. The first coupling 38 is shown to be smaller than the second coupling 48, and as a result, the radially lobed bore 35 is smaller than the radially lobed bore 39. The drawings also show the complementary fit between the radially lobed portions 30 and 31 of the drive shaft 28 and the radially lobed bores 35 and 39 of the impellers 37 and 41.

As the pinion drive shaft 28 rotates, the radially lobed portions 30 and 31 of the drive shaft 28 engage with the radially lobed bores 35 and 39 of the respective impellers 37 and 41. This engagement acts to position the impellers 37 and 41 on the pinion drive shaft 28 and eliminates any necessity for alignment or centering of the impellers 37, 41. Additionally, the rotation of the pinion drive shaft 28 with the complimentary fit of the radially lobed portions 30,31 with the radially lobed bores 35,39 limits the axial movement of the impellers 37,41 along the pinion drive shaft 28.

The preferred embodiment is a gear-driven compressor 12 using the refrigerant R134a and comprising at least a second compression stage comprising a second stage impeller 41 having a hub 42 and a radially lobed bore 39 in the hub 42. The drive shaft 28 has a second radially lobed portion 31 complementary to the radially lobed bore 39 and received in the bore 39 to define a second coupling for transmitting torque from the drive shaft 28 to the impeller 41. The preferred embodiment also has the first stage impeller 37 closer to the gas inlet 33 than the second stage impeller 37, and the cross-sectional area of the first radially lobed portion 30 preferably is larger than the cross-sectional area of the second radially lobed portion 31.

The invention has been shown and described in preferred form only, and by way of example, and many variations may be made in the invention which will still be within the spirit of the invention. Such variations include the application of this invention to direct drive compressors, to single stage compressors, and to compressors using refrigerants other than R134a. Other variations include changing the arrangement shown in the drawings, from the preferred arrangement where the first radially lobed portion 30 has its lobes axially aligned with the lobes of the second radially lobed portion 31, to an arrangement where the lobes are out of alignment anywhere in the range between 0° and 120°. Other potential variations include resizing or reshaping one or more of the lobes so that, unlike the preferred embodiment, each lobe has a slightly different size and/or shape. The mating aperture in the impeller would of course also be modified in a complementary manner and have the result that the impeller could be placed upon the shaft in only one way (unlike the present invention where there are three different ways to place the impeller upon the shaft). Another variation includes machining the lobes across the entire shaft rather than machining only the portions 30, 31. Yet another variation includes gradually expanding the radial diameter of the shaft 28 as the distance from the gas inlet 33 increases. In such case the bores 35, 39 also gradually expand in a complimentary manner. It is understood, therefore, that the invention is not limited to any specific embodiment except insofar as such limitations are included in the appended claims.

Other embodiments of the invention will be obvious to those skilled in the art from consideration of the specification and practice of the invention disclosed herein. It is intended that the specification and examples be considered as exemplary only, with a true scope and spirit of the invention being indicated by the following claims.

I claim:

1. A refrigeration compressor comprising a refrigerant gas inlet, a drive shaft, and at least one compression stage comprising at least one impeller having a hub and a radially lobed bore in said hub, said drive shaft having a first radially lobed portion complementary to said radially lobed bore and received in said bore to define a first coupling for transmitting torque from said drive shaft to said impeller.

2. A compressor according to claim 1, wherein said radially lobed portion of said drive shaft has three lobes.

3. The compressor according to claim 2 wherein the radially lobed portion is of substantially constant diameter.

4. A compressor according to claim 1, further comprising at least a second said compression stage comprising a second impeller having a second hub and a radially lobed bore in said second hub, said drive shaft having a second radially lobed portion complementary to the radially lobed bore of second said hub and received in said bore of said second hub to define a second coupling for transmitting torque from said drive shaft to said second impeller.

5. A compressor according to claim 4, wherein each of said first and second radially lobed portions of said drive shaft has three lobes.

6. The compressor according to claim 4 wherein the lobes of the first and second radially lobed portions are axially aligned.

7. The compressor according to claim 6 wherein the lobes of the first radially lobed portion are of substantially similar size and shape.

8. The compressor according to claim 7 wherein the lobes of the second radially lobed portion are of substantially the same size and shape.

9. The compressor according to claim 8 wherein the compressor uses the refrigerant R134a.

10. A compressor according to claim 5, wherein said first impeller is closer to said gas inlet than said second impeller.

11. A compressor according to claim 10, wherein the cross-sectional area of said first radially lobed portion is larger than the cross-sectional area of said second radially lobed portion.

12. A compressor according to claim 11, wherein said drive shaft is gear-driven.

13. A compressor according to claim 11, wherein said drive shaft is directly driven by a motor.

14. A compressor according to claim 2 wherein the radially lobed portion engages the radially lobed bore and limits the axial movement of the impeller on the drive shaft.

15. A centrifugal compressor comprising:

a drive shaft;

a motor operably connected to and driving the drive shaft;

a bull gear operably connected to the drive shaft and driven thereby;

a pinion drive shaft;

a pinion gear operably connected to the pinion shaft and engaged with the bull gear so as to transmit rotational movement from the drive shaft to the pinion shaft;

at least one radially lobed portion on the pinion shaft wherein the radially lobed portion has three lobes;

and at least one impeller having a mating radially lobed bore for engagement with the radially lobed portion of the pinion shaft.

16. The compressor of claim 15 wherein the at least one radially lobed portion includes first and second radially lobed portions respectively including three lobes each, and first and second impellers having mating radially lobed bores engaging with the first and second portions.

17. The compressor of claim 16 wherein the motor rotates the drive shaft at approximately 3600 RPM and wherein the pinion shaft rotates in the range of 9000 to 12000 RPM.

18. The compressor of claim 16 wherein the first radially lobed portion has a smaller cross sectional area than the second radially lobed portion.

19. The compressor of claim 18 wherein the first radially lobed portion is spaced from the second radially lobed portion by a drive shaft portion and wherein the drive shaft portion is circular in cross section.

20. A method of operating a gear driven centrifugal compressor comprising the steps of:

providing a high speed shaft and a low speed shaft;

driving the low speed shaft at about 3600 RPM;

driving the high speed shaft through a gear connection with a low speed shaft to about 9000 to 12000 RPM;

providing a first radially lobed portion on the high speed shaft and providing a mating impeller having a matching first radially lobed bore on the first radially lobed portion.

21. The method of claim 20 including the further steps of providing a second radially lobed portion on the high speed shaft axially spaced from the first portion; and providing a second impeller having a radially lobed bore mating with the second lobed portion.

22. The method of claim 21 wherein the radially lobed portions have three lobes each.

23. The method of claim 22 including the further step of interferingly engaging the radially lobed portions with the radially lobed bores so as to limit axial movement of the impellers on the high speed shaft.

24. The method of claim 23 including the further step of using the refrigerant R134a in the compressor.

* * * * *